US005956414A

United States Patent [19]

Grueninger

[11] Patent Number: 5,956,414

[45] Date of Patent: Sep. 21, 1999

[54] PRODUCT EVALUATION AND RECOGNITION SYSTEM

[75] Inventor: Baptist Grueninger, Russikon, Switzerland

[73] Assignee: Ferag AG, Hinwil, Switzerland

[21] Appl. No.: 08/521,762

[22] Filed: Aug. 31, 1995

[30] Foreign Application Priority Data

Sep. 7, 1994 [CH] Switzerland ..... 02 735/94

[51] Int. Cl.[6] ..... G06K 9/00

[52] U.S. Cl. ..... 382/112; 382/304

[58] Field of Search ..... 382/101, 112, 382/218, 304, 307; 209/583, 584; 101/484, DIG. 30; 270/1.03, 52.02

[56] References Cited

U.S. PATENT DOCUMENTS

| | | | |
|---|---|---|---|
| 4,953,841 | 9/1990 | Polarek | 270/58 |
| 5,067,088 | 11/1991 | Schneiderhan | 364/478 |
| 5,207,412 | 5/1993 | Coons, Jr et al. | 270/1.1 |
| 5,445,367 | 8/1995 | Long | 270/1.1 |
| 5,510,997 | 4/1996 | Hines et al. | 364/478 |

FOREIGN PATENT DOCUMENTS

| | | | |
|---|---|---|---|
| 0534115 | 3/1993 | European Pat. Off. | B65H 7/02 |
| WO93/18480 | 9/1993 | WIPO | 382/101 |

*Primary Examiner*—Andrew Johns
*Attorney, Agent, or Firm*—Birch, Stewart, Kolasch & Birch, LLP

[57] ABSTRACT

The method and the arrangement according to the invention for monitoring and controlling processes in the field of the further processing of products of a printing machine into finished printed products such as newspapers, magazines, and similar items is based on a functional cross-linking of a plurality of image processing modules. In each of the image processing modules clocked comparing steps are carried out in which actual images recorded by at least one image recording device are compared with reference images stored in the image processing modules and control signals are generated according to the result of the comparison and according to the momentary operating state of the image processing module. Each image processing module comprises inputs and outputs for images and inputs and outputs for control signals. Through the functional cross-linking of the image processing modules via their inputs and outputs the operating state and/or the stored reference of every image processing module becomes changeable by control signals and other image processing modules and/or by control signals generated by the module itself. Therefore, a process is not only monitored by the inventive method but can also be controlled by it.

20 Claims, 8 Drawing Sheets

PRODUCT EVALUATION AND RECOGNITION SYSTEM

The invention concerns a method according to the generic part of the independent claim for monitoring and controlling processes for further processing of products of a printing machine. The invention further concerns an arrangement according to the generic part of the corresponding independent claim for executing the method.

Products of a printing machine are further processed, e.g. by folding, cutting, collating, binding, stitching, addressing, packing etc. In the course of such processing, products of the printing machine as well as intermediate and finished printed products being produced in the further processing, are manipulated and transported on production lines that work as continuously as possible. Different products from a printing machine as well as different finished printed products resulting from the further processing, as e.g. newspapers, magazines, brochures etc. or different intermediate products of the further processing do not necessarily differ from each other regarding their form or other easily measurable physical characteristics but in their print, i.e. in their optical appearance only. Therefore monitoring methods based on image processing are increasingly used for monitoring printed products, especially since image processing methods have become sufficiently fast and simple to use. Such monitoring methods are described, e.g. in the patent application C-0178/94-8 by the same applicant or in the publication U.S. Pat. No. 4,953,841.

BACKGROUND OF THE INVENTION

According to the state of the art, in a clocked succession images are recorded of products being transported in succession past the range of a recording means, e.g. of a camera or line reading device, the recorded images are compared with a reference image and the results of the comparison are used to generate signals (alarm or control signals) with which usually a reaction to an irregular product (compared images do not correspond) is initiated, either a reaction by an alarmed operating person or a reaction by one or several correspondingly triggered parts of a device arranged further downstream, e.g. of a switchpoint for eliminating irregular products.

The use of known monitoring methods based on image processing always have an island-like monitoring function in the further processing of products of a printing machine which function must be adapted accordingly as soon as the type of processing changes. Methods for further processing in which several different products of a printing machine are processed simultaneously, e.g. when collating different printed sheets for producing a magazine, several parallel monitoring functions are needed, whereby these e.g. monitor individually the feeding of the different sheet types and must again be individually adapted for production of every given product type. For producing frequently changing product types and especially for producing so called individualized products, the known monitoring methods with image processing are still rather expensive, particularly if, for achieving a satisfactory monitoring, a plurality of image processing functions is required.

Therefore it is an object of the invention to create a monitoring and controlling method based on image processing which method can be applied for the further processing of products of a printing machine, which method is not only simple and safe even when the product types are frequently changed and/or when individualized products are produced but can also be used as controlling method for the mentioned change of product type. A further object of the invention is to create an arrangement for carrying out the method which arrangement is easily adaptable to different printed product types, to different steps of further processing and to different combinations of such steps.

SUMMARY OF THE INVENTION

The invention is based on the idea of functionally linking a plurality of image processing modules to a monitoring and controlling system for monitoring and controlling the further processing of products of a printing machine. Hereby, each image processing module is primarily a functional (method related) unit, not necessarily a physical unit in form of a device module. Substantially, in each image processing module, in a timed succession of comparing steps input images are compared with a stored reference image and control signals are output depending on the result of the comparison as well as on the momentary state of the image processing module in question. The control signals are used to control processing and/or transport devices (e.g. switchpoints) and additionally they are used for changing the momentary state of the image processing module in question and/or for changing the momentary state of further image processing modules and/or for changing the stored reference images thereof. Moreover the functionally linked system of image processing modules can be subordinated to a superimposed intelligence which again influences individual or all image processing modules such that their momentary state and/or their stored reference images are changeable also by the superimposed intelligence. Moreover this superimposed intelligence may have access to a library in which images from external sources or from image processing modules of the system can be memorized. The momentary state of individual or of all image processing modules can also be changeable by operating personnel via input means (operation means).

The function of the image processing modules is clocked, whereby the length of the clocked time intervals can be determined by a central or individual clock generator such that the function is clocked rigidly and regularly. On the other hand the length of time intervals can be determined by sensor means accordingly positioned, whereby an individual time interval is allocated to each product in a stream of products.

The image processing modules are designed such that they can be functionally linked on the one hand to image recording devices, on the other hand in various different ways to each other, to a superimposed intelligence, to input units and/or to control means of processing and/or transport devices for further processing of printed products. The image processing modules can be software units or they can be realized as being partly hardware. The arrangement according to the invention for carrying out the monitoring and controlling method according to the invention comprises a plurality of image recording devices, e.g. video cameras, and a plurality of image processing modules, whereby the image processing modules are interconnected and whereby through these connections control signals and/or image data are transferrable from module to module. For particularly simple applications possibly only a single image recording device is required.

The expression "image" used in the above description of the method according to the invention is to be understood in a very wide sense, i.e. as optically conceivable information or as digitalized form of optically conceived or conceivable information. The "image" can therefore be a printed pattern (graphic chart, text, etc.), an "image" in the actual sense of the word or a code (e.g. bar code) or digitalized data representing one of those. Depending on the kind of "image" to be processed, different known devices are used as image recording devices such as e.g. video cameras or laser reading-heads.

The method and the arrangement according to the invention, especially the image processing module and possible functional links between image processing modules as well as applications of the method according to the invention in the area of further processing of products of a printing machine are described in detail in connection with the following figures.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 1 shows the functional diagram of an exemplified image processing module on which the method and the arrangement according to the invention are substantially based.

DETAILED DESCRIPTION OF THE INVENTION

Figure 1:
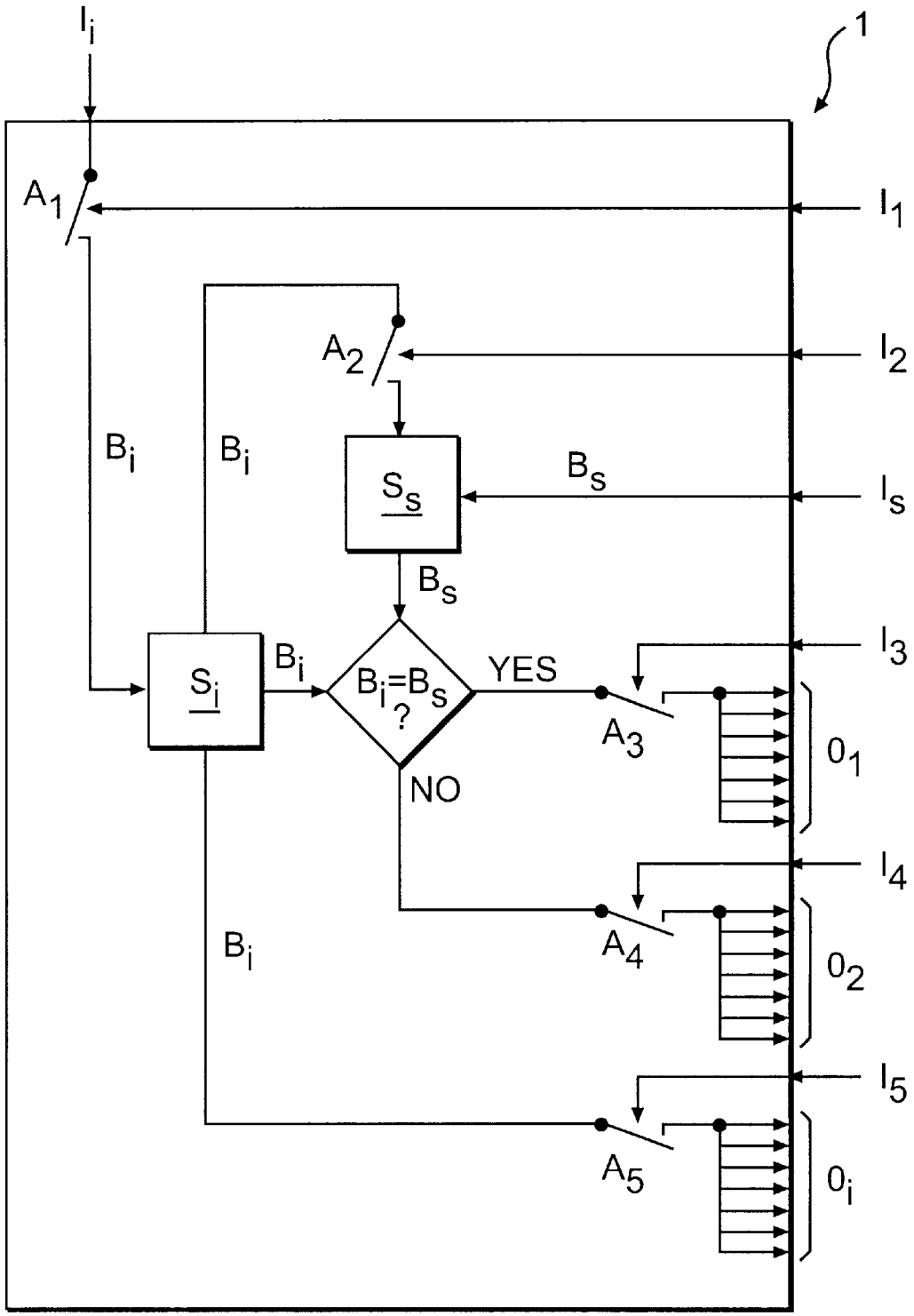
FIGS. 1 to 3 show functional diagrams of examples of image processing modules.

The central functional element of the image processing module 1 is a comparing unit (Bi=Bs?) for comparing a recorded image (Bi or actual image) with a stored reference image (Bs) or for comparing the digitalized data of an actual image with the digitalized data of a reference image. The actual image Bi (or corresponding digitalized data) is input from an external source, e.g. from an image recording device, from another image processing module or from a superimposed intelligence (not shown in the figure) via an actual image input Ii into an actual image memory Si, whereby an image already stored in the actual image memory is overwritten. An overwriting of the actual image memory Si initiates a comparing step in the comparing unit (Bi=Bs?).

The reference image Bs (or digitalized image data of a reference image) is supplied e.g. by another module or by a superimposed intelligence from an image library and is input into the module via a reference image input Is and stored in a reference image memory Ss where it is available for the comparing unit (Bi=Bs?). The reference image memory Ss may however be overwritten also with the actual image Bi available from the actual image memory Si of the same module.

The comparing unit (Bi=Bs?) initiates the generation of control signals which are available with different delays at outputs O1, when the actual image and the reference image are the same (output "yes"), at outputs O2 when the actual image and the reference image are not the same (output "no"). The image processing module comprises at least one group of outputs O1 and at least one group of outputs O2.

The actual image Bi gets available also for external use with different delays at the outputs Oi.

In the functional diagram the points with two different configurations are shown as switches A1 to A5, whereby the momentary state of processing of the image processing module is defined by the sum of the momentary configurations of these configuration switches. The configurable points or configuration switches A1 to A5 can be configured by corresponding signals imputed at inputs I1 to I5, whereby they are switched from one configuration to the other by one such control signal. The control signals for configuration of switches A1 to A5 can originate from outputs of the same image processing module or from outputs of other image processing modules, from a superimposed intelligence or from corresponding operation units. In order to stay within the chosen image of the (functional) switch for the configurable points A1 to A5 the terms closed (symbol: ---) and open (symbol: --) are used for their two possible configurations in the following description.

Switch A1 decides whether or not the actual image memory Si is to be overwritten with an actual image Bi presently available and also whether a comparison is to be carried out (A1 closed) or not (A1 open). Switch A1 also decides whether or not the actual image Bi is available for overwriting the reference image memory Ss and for image output Oi. A1 is functionally the main switch of the module. When A1 is open no comparison of images is carried out and no control signals are generated.

Switch A2 decides whether or not the reference image memory Ss is to be overwritten with the actual image memory Si (A2 closed: yes; A2 open: no).

Switch A3 decides whether or not control signals with or without delay are to be available at outputs O1, when an actual image is the same as the reference image, (A3 closed: yes; A3 open: no). Switch A4 decides whether or not control signals are to be available with or without delay at outputs O2, when an actual image is not the same as the reference image (A4 closed: yes; A4 open: no).

Switch A5 decides whether or not the actual image is available at image outputs Oi (with or without delay) after overwriting of the actual image memory (A5 closed: yes; A5 open: no).

The function of an image processing module, as mentioned earlier, is clocked. Hereby the following routines are run through in each time interval, providing that they are possible for the present state of the module (configuration of configuration switches):

- change configuration of the configuration switches by control signals delayed to the present time interval;
- overwrite actual image memory with external image (actual image), compare images and generate control signals;
- change configuration of configuration switches by not delayed control signals;
- overwrite reference image memory with actual image.

It is easily possible to one skilled in the art to realize an embodiment of an image processing module according to the functional diagram of FIG. 1 and the above clocked routine consisting partly of hardware and partly of software. One skilled in the art will also easily recognize that the functional diagram is obviously variable without a substantial change of function. Thus it is obvious that the function of configuration switch A1 combined with a comparison of images initiated by the overwriting of the actual image memory, could be replaced by a configuration switch between the actual image memory and the comparing unit (as well as in the other exits of the actual image memory). Thus the functional diagram shown is to be understood as an exemplified functional drawing. For universal applicability of the image processing module the mentioned inputs and outputs are necessary, whereas for specific applications they are only partly necessary.

It is of no importance to the method according to the invention, what kind of image data is compared in the comparison unit, i.e. every kind of image recording device, which supplies an automatically comparable image, can be used with an accordingly equipped comparing unit, whereby a possibly required digitalization of the recorded image can be carried out in the recording unit, between recording device and image processing module or in the image processing module. It is also possible to use, in a basically known manner, as reference image only a part of a recorded image and, when comparing this reference image with an actual image, to search the smaller reference image within a range of tolerance on the actual image, such equalizing tolerable differences in the position of the products to be monitored.

For the most simple application of the image processing module, e.g. for its application as an island-like monitoring organ controlling e.g. a switchpoint for eliminating irregular products (products for which actual image and reference image do not correspond) the state of the image processing module is constant, as follows: A1: --- (closed), A2: - - (open), A3: - -, A4: --- and A5: - -. The actual image input Ii is connected to an image recording device. The control signal for the switchpoint is available at the output 02 with a delay that corresponds to the distance (in time intervals) between monitoring point and switchpoint.

For operation with a control function when actual image and reference image correspond, the state of the image processing unit is also constant: A1: ---, A2: - -, A3: ---, A4: - - and A5: - -. At least one output of output group O1 is connected with a device to be triggered or with the control of such a device.

Figure 2:
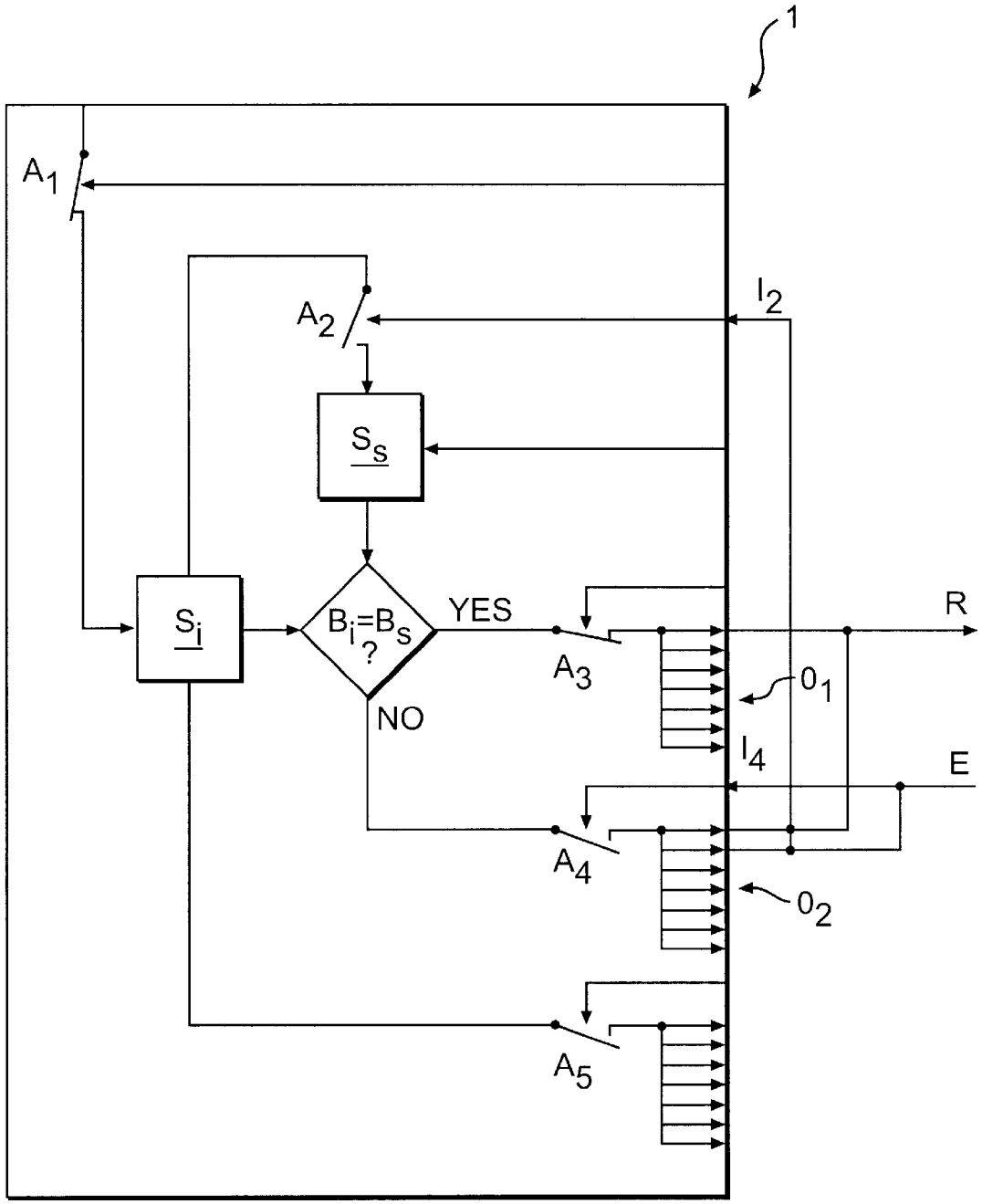

FIG. 2 shows the same functional diagram for an image processing module as FIG. 1, whereby the inputs and outputs are internally connected such that control signals are generated when actual image equals reference image, is additionally able to automatically give itself a new reference image.

The state of operation is thus as follows: A1: ---; A2: - -; A3: ---; A4: - -; A5: - -. This means: when the actual image corresponds to the reference image a possibly delayed control signal for a control function is available through a connection R to output O1. By closing A4 by an external control signal (arrow E) the image processing module is brought into a standby condition in which it reacts to a next product which does not correspond to the reference image with a change of the reference image. When A4 is closed, A2 will be closed by the next product for which actual image is not equal to reference image, through the undelayed connection between O2 to I2 and the reference image memory is overwritten with the actual image. With one time interval of delay, through the connection of O2 with I2 and with I4, A2 and A4 are then reopened and thus the module is again in its normal operating state. In order to not treat the first product of a new type whose image was used to overwrite the reference image memory as a "bad" product output O2 is also connected to connection R in an undelayed manner such that for this product a control signal is transmitted as if for a "correct" product.

A further overwriting of the reference image storage becomes possible again when the image processing module has been switched into a stand-by state by closing A4 by means of an external control signal (arrow E). In a cross-linked system which comprises a plurality of image processing modules and possibly further elements such an external control signal can e.g. be supplied by another image processing module.

Figure 3:
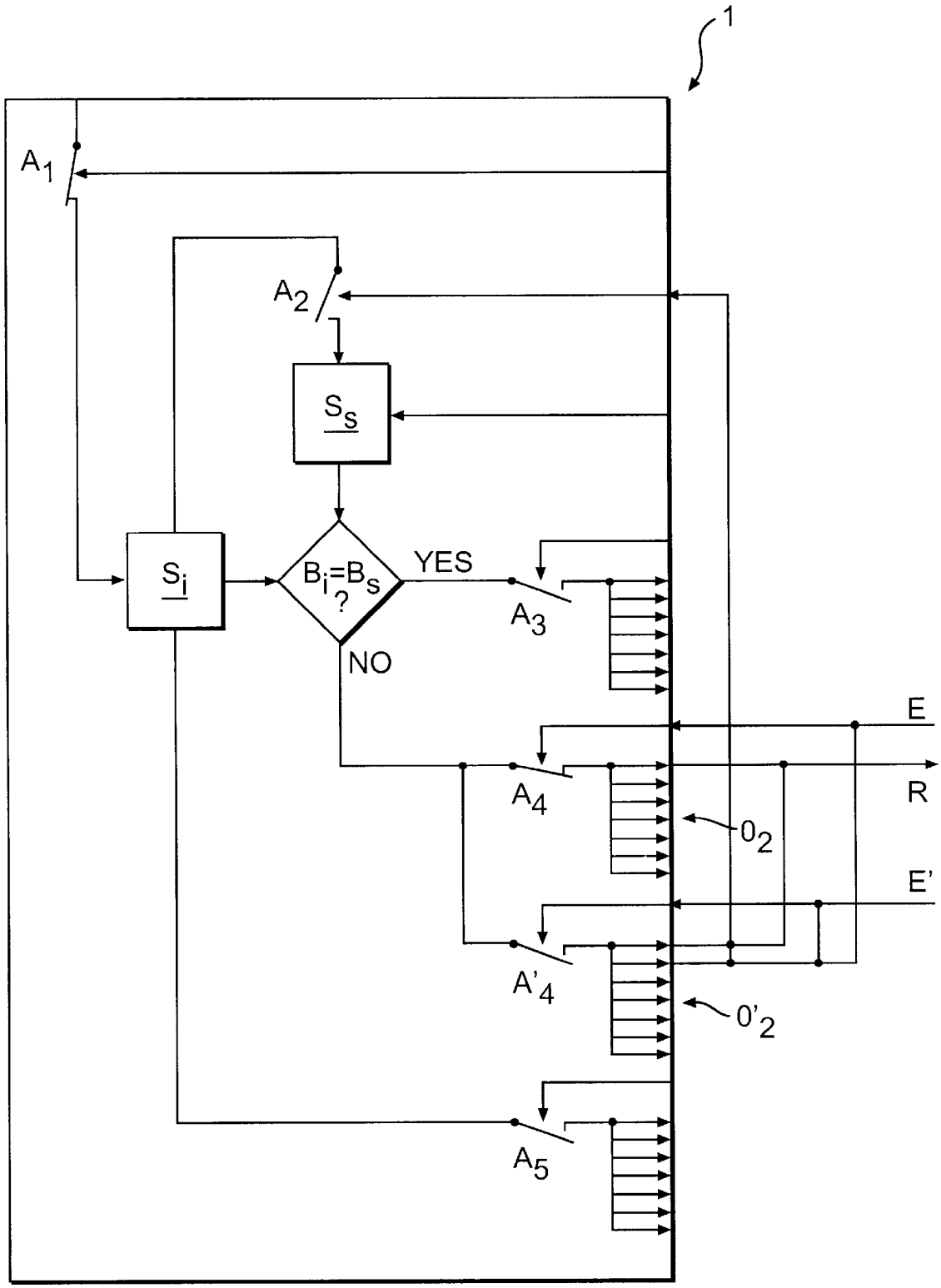

FIG. 3 shows a functional diagram for an image processing module substantially identical to FIG. 1, whereby it comprises two functionally identical groups of outputs O2 and O'2 with two configuration switches A4 and A'4 and whereby outputs and inputs are cross-linked such that the module, when in operation with a control function active for actual image not equal to reference image, is able to supply itself automatically with a new reference image.

The normal operating state of the image processing module is: A1: - -; A2: - -; A3: - -; A4: ---; A'4: - -; A5: - -, such that control signals for a control function (arrow R) are available from outputs O2.

A4 is opened and A'4 closed by external control signals (arrows E and E') bringing the module into a standby configuration. By the next product which does not correspond to the reference image, the reference image memory will be overwritten with the actual image through a connection described earlier in connection with FIG. 2 and in the following time interval the module is switched back into the normal operating state.

Figure 4:
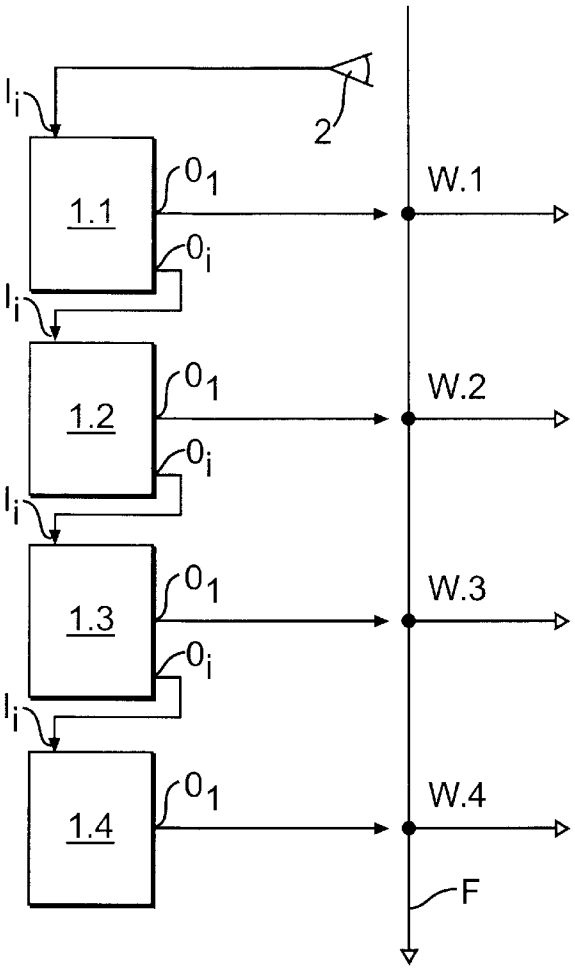
FIGS. 4 and 5 show an application of the method according to the invention for sorting out printed products (FIG. 4) and in detail an image processing module (FIG. 5) installed for this application.

FIG. 4 shows a simple, cross-linked system of e.g. four image processing modules 1.1 to 1.4 and one image recording device 2. This system serves for controlling a sorting line in which from an infed stream of printed products of different types, each of four switchpoints W.1 to W.4 withdraws one type of products while products of jet other types are transferred further on sorting line F. The system is able to adjust itself to four different types of products.

The image recording device 2 is connected to the actual image input Ii of the first (1.1) of the four image processing modules 1.1 to 1.4 connected to form a functional line. The output O1 of each module is connected to the control of the switchpoint allocated to it with a delay which corresponds to the distance (in time intervals) between the image recording device 2 and the switchpoint.

Figure 5:
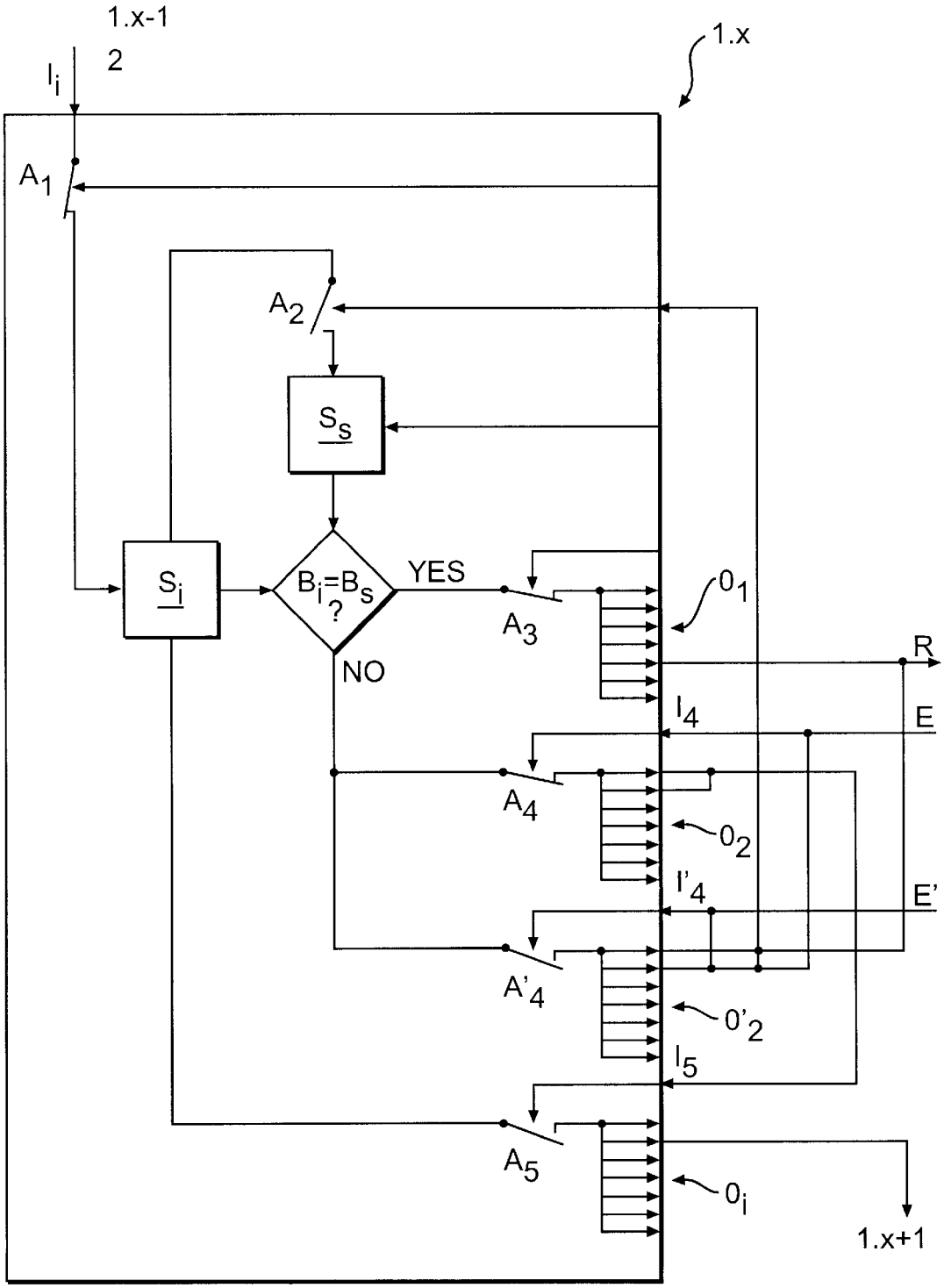

FIG. 5 shows the functional diagram of one (1.x) of the modules 1.1 to 1.4 of FIG. 4. The module comprises, similar to the module according to FIG. 3, two groups of outputs O2 and O'2 with two corresponding configuration switches A4 and A'4. The normal operating state is; A1: ---; A2: - -; A3: ---, A4: ---; A'4; - -; A5: alternating. The actual image input Ii of the module is connected to the image output Oi of the frontmost module 1.x−1 in the line or with the image recording device 2. Control signals for the switchpoint allocated to the module are available on outputs O1. Thus, with a product that corresponds to the reference image stored in the module, the switchpoint is set for diverting the product from the steam and the switchpoint it is set back immediately afterwards. *The control signals for the switchpoint must be delayed according to the distance between image recording device and switchpoint, corrected by the position of the module in the line (e.g. four time intervals). Through the connections between outputs O2** and inputs I5 and between image output Oi and the next following image processing module (Ii of module 1.x+1) the actual image is supplied to the actual image input (Ii of the following image processing module 1.x+1 when actual image and reference image do not correspond.

The outputs O'2 as well as I4 and I'4 are connected substantially in the manner already described for operation with a stand-by configuration (A4: - -; A'4: ---), with an overwriting of the reference image memory followed by a restoring of the normal operating state.

The modules of the cross-linked system according to FIG. 4 are all switched to stand-by configuration at the beginning of the sorting process. The reference image memory of module 1.1 is overwritten with the image of the first product, the reference image memory of module 1.2 with the image of the next different product etc. Products which are of a fifth or yet a further different type are not diverted from the main conveying stream.

Figure 6:
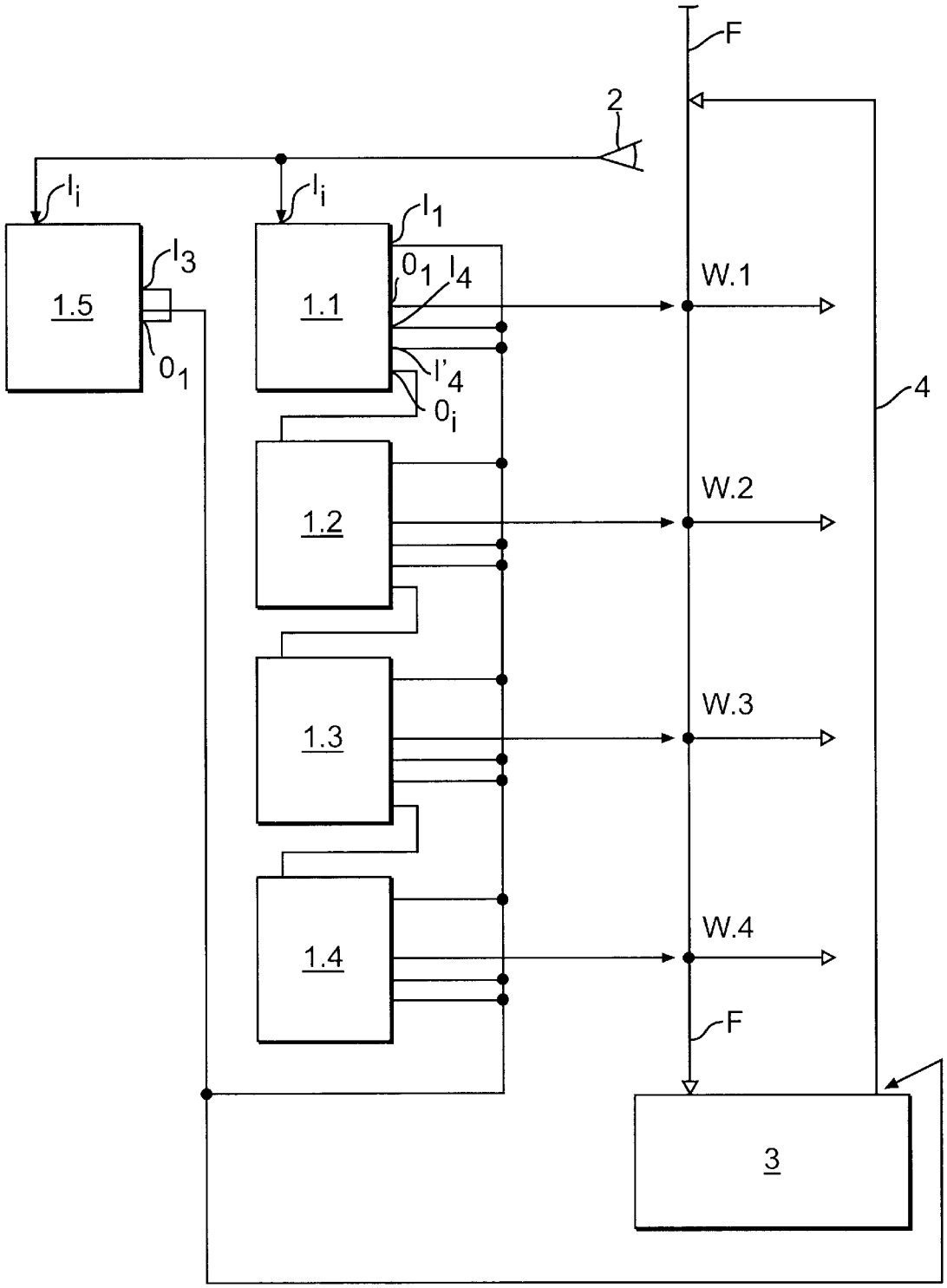
FIG. 6 shows the application of the method according to the invention for sorting printed products with recirculation.

FIG. 6 shows a sorting facility and the monitoring- and controlling method belonging to it according to FIG. 4 installed such that when all products of the stream have passed through the facility, the not diverted products (fifth and further types) are fed back into the facility, which adjusts automatically to the sorting out of the next four types of products and carries this out.

The installation contains a product buffer 3 at the end of sorting line F, a product recirculation 4 entering the sorting line F before the control point (position of image recording device 2) and a further image processing module 1.5. The reference image of module 1.5 is the image of a vacancy (no product) on the feeding line. The operating state of module 1.5 is A1: ---; A2: - -; A3: alternating; A4: - -; A5: - -. The actual image input Ii of module 1.5 is connected to image recording device 2. For initialization of the recirculation, the output 01 of module 1.5 is connected (with corresponding delay) to the control of the exit of buffer 3. For the deactivation and reactivation of the modules 1.1 to 1.4 between sorting process and recirculation, the output O1 of module 1.5 is connected (with corresponding delay) to their inputs I1. For establishing stand by configuration of the modules 1.1 to 1.4, output O1 of module 1.5 is connected (with corresponding delay) to their inputs I4 and I'4. With a delay of one time interval (to open A3) and with a delay of as many time intervals as vacancies before recirculation are to be expected in the conveying line one of each outputs of output group O1 of module 1.5 is also internally connected to input I3 such that the necessary control signal for opening the buffer output is only generated with the first vacancy in the feeding line and that the module 1.5 is set back into its operating state as soon as the first of the recirculated products has passed the control point.

Figure 7:
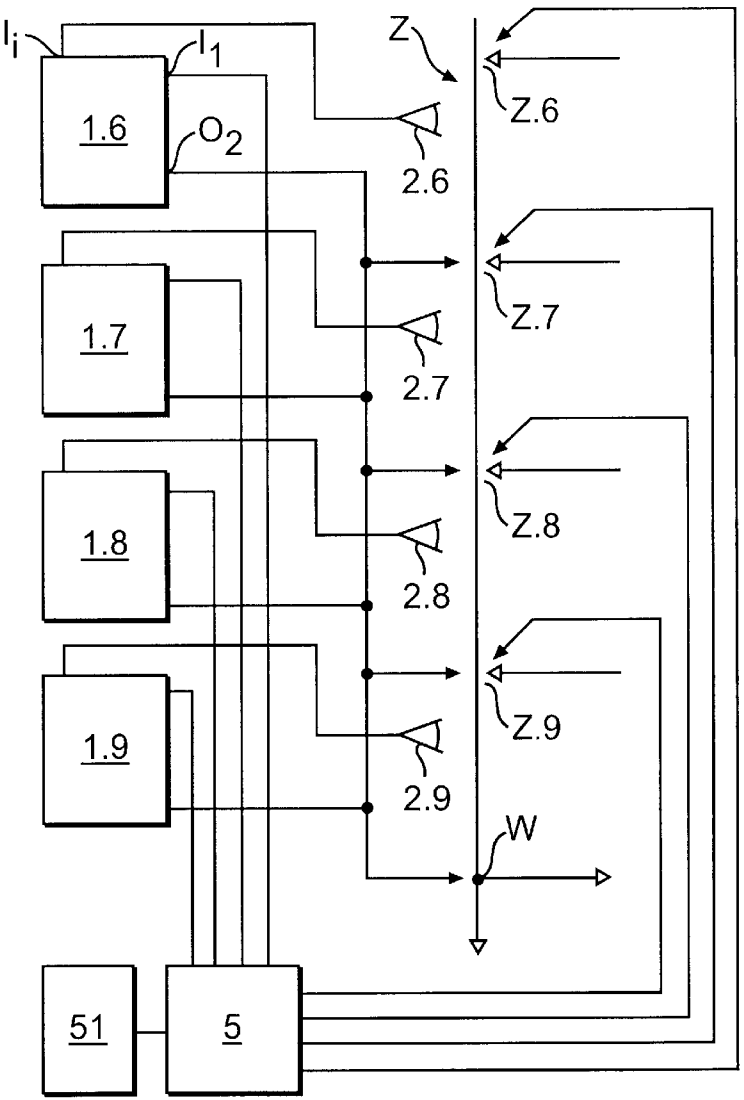
FIGS. 7 and 8 show the application of the method according to the invention for producing individualized printed products by controlled collating of part-products (FIG. 7) and in detail an image processing module (FIG. 8) installed for this application.

FIG. 7 shows a further exemplified application of the method and the arrangement according to the invention. This is a step of further processing in which different types of printed products (sheets) from supplies Z.6 to Z.9 are collected on a collecting line Z to form a group and in which faulty groups are eliminated by a switchpoint W at the end of collecting line Z. The supplies are controlled by a superimposed intelligence 5 such that the groups formed have predetermined individual compositions, i.e. that the groups formed only contain selected products of the types supplied. An image library 51 in which e.g. the images of successively printed products are stored can be associated to the superimposed intelligence. This arrangement makes flying changes of products possible, for which flying changes the reference image memories of the modules are overwritten in the corresponding time intervals by the superimposed intelligence with the reference images for the following production which reference images are read out of the image library for this purpose.

Four image processing modules 1.6 to 1.9 are installed for carrying out the variant according to FIG. 7 of the inventive method, each of these modules being connected with an image recording device 2.6 to 2.9. The image recording devices monitor the collecting line one after each supply, i.e. they monitor the group being formed each time a sheet has been added.

Figure 8:
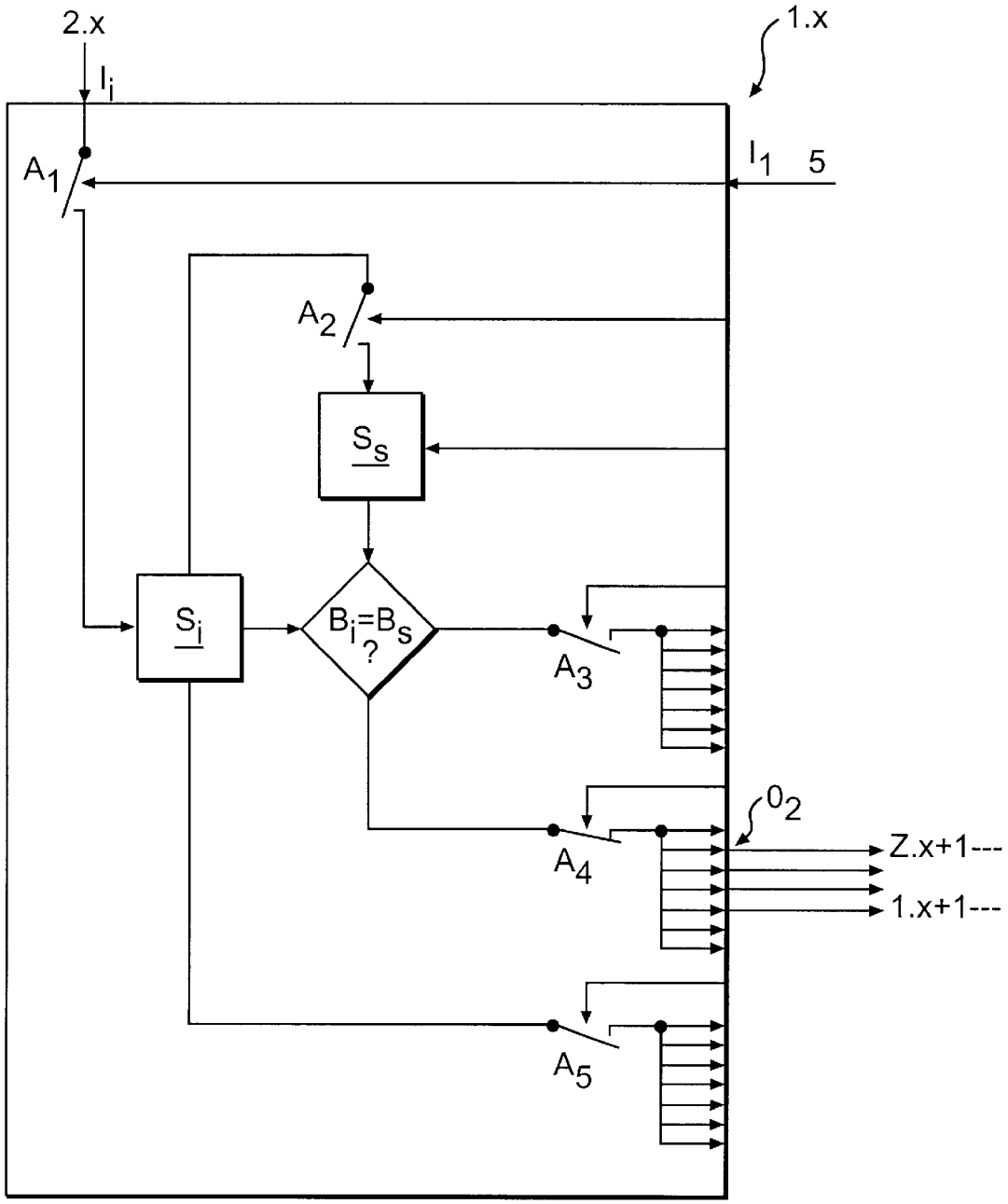

FIG. 8 shows one (1.x) of the modules 1.6 to 1.9 of FIG. 7 in detail. The reference image stored in the module corresponds to a sheet added to the group immediately before monitoring and e.g. originates from the image library 51 from which it is read by the superimposed intelligence and written into the reference image memory of the module. The operating state of the module is: A1: alternating; A2: - -; A3: - -; A4: ---; A5: - -. The actual image input Ii is connected to the corresponding image recording device 2.x. The input I1 is connected to the superimposed intelligence 5 for suppressing an image comparison when no sheet has been added to the group (individual composition). The outputs O2 are connected to the controls of the supplies cooperating with the modules Z.x+1, Z.x+2 with the corresponding delays such that no further product is supplied to a group as soon as a fault in the supply to this group has been detected. Furthermore outputs O2 are connected with the same delays to the inputs I1 of the following image processing modules 1.x+1, 1.x+2 such that the corresponding monitoring steps are suppressed also.

FIGS. 4, 6 and 7 show exemplified applications for the method and the arrangement according to the invention. Hereby the applications are relatively simple. The functional diagram of the image processing module allows further simple applications and especially combinations of functions and applications.

FIG. 9 shows, again in a functional diagram, an example of such a combination which represents a more complex case of application for the method according to the invention. This is the combination of a collating line Z with a group of stations for joining (stitching, gluing etc.) the collated part-products and a sorting line F for sorting out parts of eliminated faulty groups, whereby the sorted product parts are recirculated to the supplies of the collating line. With the help of this example of a more complex application especially the control of a change of product type is to be explained. In the Figure the paths of the products are shown with unbroken lines and the connections for transmission of data are shown with broken lines. In order not to overstrain the Figure unnecessarily, only the most important data connections between the image processing modules are shown and the positions where these connections are linked to the image processing modules does no longer correspond to the input and output positions of FIGS. 1 to 3.

Collating line Z comprises four supplies Z.1 to Z.4, whereby the main part of the product to be produced is conveyed quasi continuously, e.g. from the printing machine, through supply Z.1 via a buffer 6. On the further supplies Z.2 to Z.4 three further parts are supplied to the groups to be collated on line Z, e.g. from rolls or stacks. In order to make possible a flying change of production, two supply paths with corresponding roll or stack positions (Z.20 and Z.21 etc.) are provided for each supply Z.2 to Z.3. At the end of collating line Z there is a switchpoint W for eliminating faulty groups from the main stream of products. The faulty groups are conveyed to an individualising station 7 for individualising the parts thereof and to a following sorting line F with switchpoints W.1 to W.4. Through the sorting switchpoints W.1 to W.4 and possibly through further following switchpoints W.21 to W.41 the sorted product parts are conveyed to the corresponding supply paths Z.1, Z.20, Z12 etc. Groups compiled faultlessly in collating line Z are conveyed through switchpoint W to a group G of joining stations. This group G comprises e.g. a bypass 8 for products whose parts are not to be joined, a stitching station 9 and a gluing station 10 as well as corresponding switchpoints G.1 and G.2.

Figure 9:
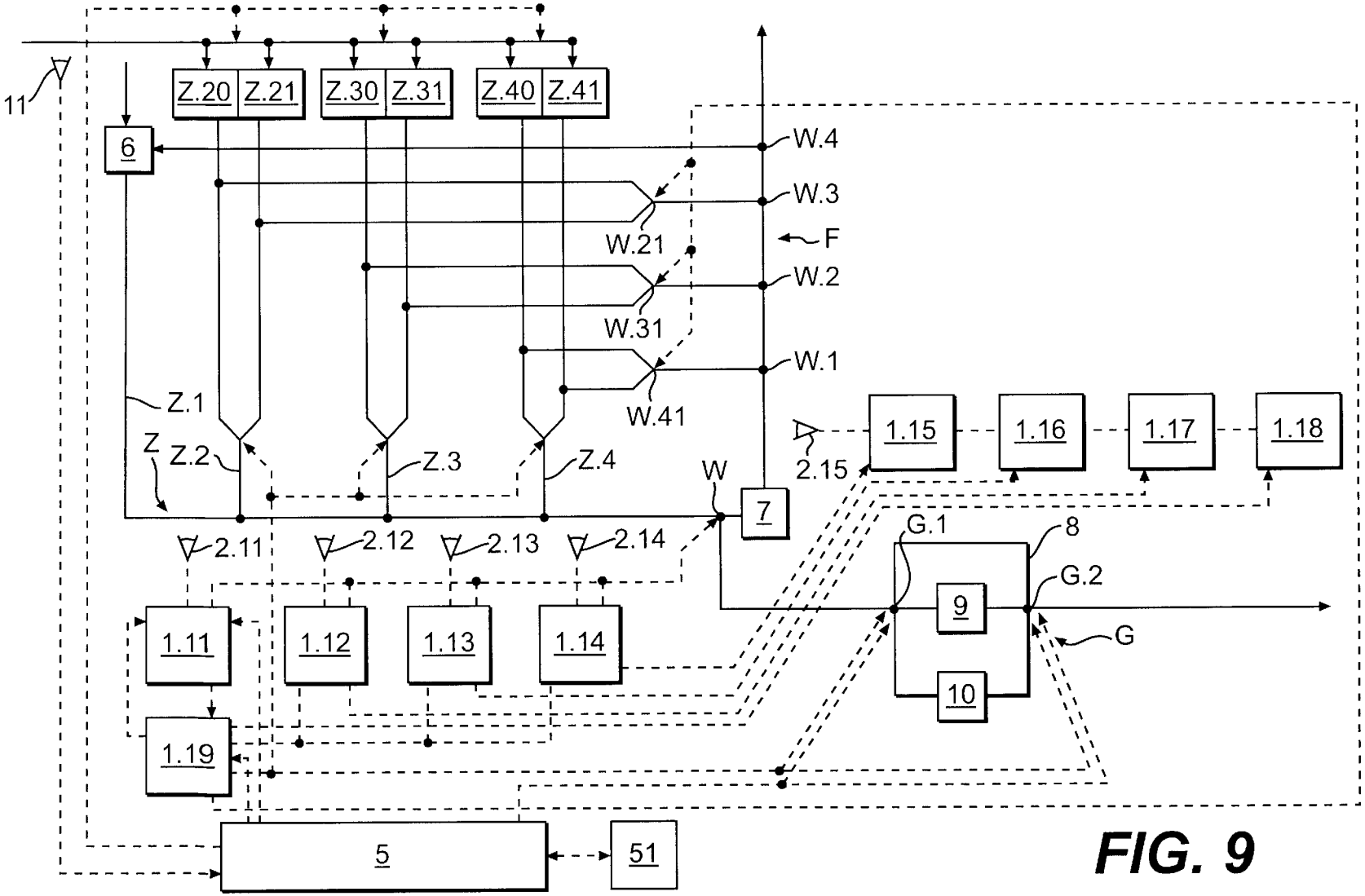
FIG. 9 shows the application of the method according to the invention in an exemplified combination of different further processing steps.

The arrangement according to FIG. 9 comprises a superimposed intelligence and an image library 51 which contains data concerning images of the main product parts to be processed, identification characteristics of further product parts in form of rolls and/or stacks, allocations of product parts to main product parts and to supplies as well as concerning allocation of a certain joining manner to a certain main product part. The arrangement further comprises, in functions substantially already described in connection with FIGS. 4, 6 and 7, four image processing modules 1.11 to 1.14 with image recording devices 2.11 to 2.14 for monitoring the collating and a further image recording device 2.15 and four further image processing modules 1.15 to 1.18 for controlling the sorting line F. For monitoring the main part supply Z.1, apart from image processing module 1.11, a further image processing module 1.19 is provided. For monitoring the allocation of rolls and/or stacks of further product parts to supplies a reading device 11 is provided.

The method according to the invention works as follows in an application according to FIG. 9. In normal operation, i.e. whilst processing a momentarily supplied type of main product part, the image processing modules 1.11 to 1.14 monitor the supply and control switchpoint W. The modules 1.15 to 1.19 monitor the sorting and control the sorting switchpoints W.1 to W.4. The further product parts are identified in form of rolls or stacks by reading device 11 and are allocated by the superimposed intelligence to the supply paths according to the identification. According to this allocation the additional switchpoints W.21 to W.41 are also set. The reference image of module 1.11 corresponds to the type of main product part momentarily processed and originates from image library 51. The reference images of modules 1.12 to 1.14 correspond to the further product parts which are to be collated together with this type of main product part. The reference image of modules 1.15 to 1.18 are identical to the reference images of modules 1.11 to 1.14.

For a "flying" change of production the supply paths for further product parts (e.g. Z.12, Z.31 and Z.41) not used for the momentary production are equipped with rolls and/or stacks of further product parts according to the indication of the superimposed intelligence. The reference image for the main product part to be processed next is written into the reference image memory of module 1.19 from the image library by the superimposed intelligence. The next setting of switchpoints G.1 and G.2 is determined. Module 1.11 still monitors supply Z.1 of the main product part, whereby as soon as actual image and reference image do not correspond any longer, the actual image is transferred to module 1.19. If the actual image corresponds to the reference image of the next main product part to be processed (reference image of module 1.19) the following steps are initiated with corresponding delays by module 1.19: overwriting of the reference image memory of module 1.11 with the image of the new main product part, changing of the supply paths (e.g. of Z.20 to Z.21) to the supplies Z.2 to Z.4, establishing standby configuration for overwriting the reference image memory of modules 1.12 to 1.14, setting the switchpoints G.1 and G.2 to the predetermined positions.

The pairs of modules 1.11/1.18, 1.12/1.17, 1.13/1.16 and 1.14/1.15 are linked such that the overwriting of the reference image memory of the module of the collating line initiates a corresponding overwriting of the reference image memory of the module of the sorting line with a corresponding delay.

Taking the above description as an exemplified model countless further applications of the method according to the invention can be planned and realized. In doing so, it must be taken into account that apart from a control function for identifying and eliminating or correcting faults the method according to the invention can especially be used for control functions to control steps of further processing or combinations of steps for further processing. Thus e.g. the application of the method shown in FIG. 4 can be linked to a printing machine which successively turns out printed products which must be processed further in various different ways. Switchpoints W.1 to W.4 are then not to be simply seen as switchpoints for taking specified products out of a product stream but as means for allocating product types to specific ways of further processing. For such a case the obtaining of reference images as well as the allocation of a certain product type to a certain way of further processing cannot be done in a learning process but the corresponding data must be made available by a superimposed intelligence.

I claim:

1. A method of operation for a product evaluating machine, the product evaluating machine including a plurality of image processing modules for evaluating a stream of products, and at least one image recording device, the method comprising the steps of:

recording at least one actual image of a product of the product stream using said at least one image recording device;

reading a first actual image using a first image processing module of said plurality of image processing modules, wherein said first image processing unit is further used in comparing the first actual image of the product to a first reference image to arrive at a first result representing whether the first actual image is considered equal to the first reference image or not, and generating a first control signal in response to the first result, and an operating state of the first image processing module; and reading a second actual image using a second image processing module of said plurality of image processing modules, wherein said second image processing unit is further used in comparing the second actual image of the product to a second reference image to arrive at a second result representing whether the second actual image is considered equal to the second reference image or not, and generating a second control signal in response to the second result, and an operating state of the second image processing module.

2. Method as set forth in claim 1, further including the step of:

using at least one of said first or second control signals to initiate a change of at least one of the first or second reference images.

3. Method as set forth in claim 2, wherein said product evaluating machine further includes a master controller, the method further including the step of:

changing said first or second operating state in response to a signal from said master controller.

4. Method as set forth in claim 3, wherein said product evaluating machine further includes a reference image library, the method further including the step of:

changing at least one of the first or second reference images to an image stored in said reference image library in response to a command from said master controller.

5. Method as set forth in claim 4, wherein the operating state of the first or second image processing module is determinative of whether the first reference image is replaced by an image stored in said reference image library or replaced by another actual image recorded by said at least one image recording device.

6. Method as set forth in claim 1, wherein said product evaluating machine further includes an input terminal, the method further including the step of:

changing said first or second operating state in response to said input terminal.

7. Method as set forth in claim 1, wherein said first image processing module generates plural first control signals, and wherein the first image processing module generates individual ones of said plural first control signals at different times.

8. Method as set forth in claim 1, wherein said product evaluating machine further includes a master controller, the method further including the step of:

changing said first or second operating state in response to a signal from said master controller.

9. Method as set forth in claim 8, wherein said product evaluating machine further includes a reference image library, the method further including the step of:

changing at least one of the first or second reference images to an image stored in said reference image library in response to a command from said master controller.

10. Method as set forth in claim 9, wherein the operating state of the first or second image processing module is determinative of whether the first reference image is replaced by an image stored in said reference image library or replaced by another actual image recorded by said at least one image recording device.

11. Method of claim 1, wherein the first actual image is the same image as the second actual image, and the first reference image is a different image than the second reference image.

12. A product evaluating apparatus for evaluating a product of a product stream, and determining whether the product is considered equal to, or different from, at least one reference product, the apparatus comprising:

at least one image recording device for recording at least one actual image of said product; and a plurality of image processing modules including; a first image processing module being capable of reading a first actual image and comparing said first actual image with a first reference image, and generating a control signal or signals representative of whether said first actual image is considered equal to, or different from, said first reference image; and a second image processing module being capable of reading a second actual image and comparing said second actual image with a second reference image, and generating a control signal or signals representative of whether said second actual image is considered equal to, or different from, said second reference image;

wherein each image processing module is connected to at least one other image processing module such that said control signal or signals, an actual image, or a reference image, may be transmitted therebetween.

13. Apparatus of claim 12, wherein each image processing module includes:

memory for storing an actual image and a reference image;

a comparing unit for comparing the actual image with the reference image; and at least one configuration switch for setting an operating state of the image processing module.

14. Apparatus of claim 13, further comprising:

at least one input unit, wherein said at least one input unit is connected to said at least one configuration switch of at least one of said image processing modules.

15. Apparatus of claim 12, further comprising:

a master controller, wherein at least one of said plurality of image processing modules is connected to said master controller for reciprocal transmission of said control signal or signals, an actual image, or a reference image.

16. Apparatus of claim 15, wherein each image processing module includes:

memory for storing an actual image and a reference image;

a comparing unit for comparing the actual image with the reference image; and at least one configuration switch for setting an operating state of the image processing module.

17. Apparatus of claim 16, further comprising:

at least one input unit, wherein said at least one input unit is connected to said at least one configuration switch of at least one of said image processing modules.

18. Apparatus of claim 15, further comprising:

a reference image library, wherein said master controller is in communication with said reference image library so that an image stored in said reference image library may be transmitted to said at least one of said plurality of image processing modules for use as a reference image.

19. Apparatus of claim 18, wherein each image processing module includes:

memory for storing an actual image and a reference image;

a comparing unit for comparing the actual image with the reference image; and at least one configuration switch for setting an operating state of the image processing module.

20. Apparatus of claim 12, wherein the first actual image is the same image as the second actual image, and the first reference image is a different image than the second reference image.

* * * * *